United States Patent [19]

Notelteirs et al.

[11] 4,101,798

[45] Jul. 18, 1978

[54] ELECTRIC LAMP WITH A TORPEDO SHAPED CONDUCTOR TIP

[75] Inventors: Victor Rosallie Notelteirs; René Maria Vosters, both of Eindhoven, Netherlands

[73] Assignee: U.S. Philips Corporation, New York, N.Y.

[21] Appl. No.: 799,720

[22] Filed: May 23, 1977

[30] Foreign Application Priority Data

Jun. 21, 1976 [NL] Netherlands ..... 7606691

[51] Int. Cl.[2] ..... H01K 1/40

[52] U.S. Cl. ..... 313/315; 313/51; 174/126 R; 339/102 R

[58] Field of Search ..... 313/51, 315; 174/74 R, 174/126 R; 307/147; 339/102 R, 102 L

[56] References Cited

U.S. PATENT DOCUMENTS 3,549,933 12/1970 Smalley ..... 313/51 X 3,668,391 6/1972 Kimball ..... 313/315 X

*Primary Examiner*—Alfred E. Smith

*Assistant Examiner*—Robert E. Wise

*Attorney, Agent, or Firm*—Frank R. Trifari; Robert S. Smith

[57] ABSTRACT

External cylindrical current conductors of an electric lamp are torpedo-shaped at the end which is welded to a metal foil in a pinch seal of the lamp vessel.

The torpedo-shaped part has a length which is at least equal to the diameter of the cylindrical part, while the diameter of the torpedo-shaped part at a distance from the cylindrical part of 0.9 times the cylinder diameter is at most equal to half the cylinder diameter.

Also when comparatively thick external current conductors, approximately 1.5mm diameter, are used and at a high temperature of the pinch seal, the lamps will withstand cracking. The welded joint of the conductors to the metal foil is stronger than in known lamps.

2 Claims, 3 Drawing Figures

ELECTRIC LAMP WITH A TORPEDO SHAPED CONDUCTOR TIP

Figure 1:
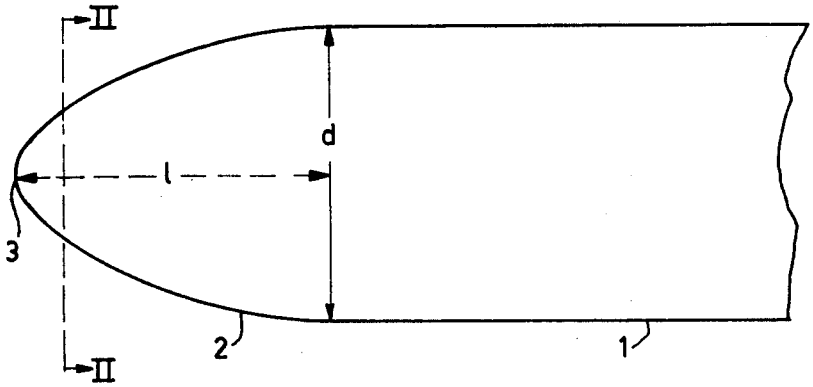

The invention relates to an electric lamp having a glass lamp vessel with at least one pinch seal, in which at least one metal foil is incorporated as a current leadthrough conductor, to at one end of which is connected an internal current conductor towards an electrically conductive member situated inside the lamp vessel and the opposite end of which is connected to an external current conductor comprising a cylindrical rod extending for the greater part outside the pinch seal, said rod having, at its end situated within the pinch seal, a non-cylindrical shape.

Such lamps are known inter alia from German Offenlegungsschrift 2,006,193.

In lamps in which there exists a great difference between the coefficients of thermal expension of the glass of the lamp vessel and the metal of the current leadthrough conductor, as is the case when molybdenum in quartz glass is used, resource has had to be made to the use of foils as current leadthrough conductors so as to prevent cracking of the pinch seal. If, however cylindrical rods of molybdenum having a diameter of more than 0.7 mm are used as external current conductors, cracking occurs already during the manufacture of the lamp after cooling the pinch seal.

Cracking is checked with external current conductors as they are used in lamps according to the above-mentioned Offenlegungsschrift in which the end situated inside the pinch seal is ground flat.

This is the case also with external current conductors which are pressed flat at the end instead of being ground. Lamps having such current conductors are disclosed in German utility model 1,952,467.

It has been found, however, that in spite of taking these measures in the known lamps, cracking nevertheless occurs during operation of a lamp in the case in which external current conductors are used having a diameter of more than 0.7 mm. For example, in a quartz glass projection lamp of 15V/150W having a flat ground molybdenum current conductor of 1 mm diameter, cracking of the pinch was found during operation in 30% of the lamps, whilst a 10% reject rate was found as a result of cracking during operation of the same lamps having flattened current conductors.

It is the object of the invention to provide lamps of a simple construction which, even in circumstances in which the temperature of the pinch seal assumes a high value, for example to above 400° C, — for example, when the pinch seal is incorporated in the neck of a reflector — are more reliable and substantially resistant to cracking.

According to the invention this is achieved in lamps of the kind mentioned in the preamble in that the external current conductor at its end situated inside the pinch seal is in the form of a torpedo having a blunt or non-blunt tip, the length of the torpedo-shaped part being at least equally large as the diameter of the cylindrical part, the diameter of the torpedo-shaped part at a distance from the cylindrical part of 0.9 times the cylinder diameter being at most equal to half the cylinder diameter.

It has surprisingly been found that the lamps are reliable even at high pinch temperatures and with external current conductors of approximately 1.5mm diameter.

In those cases in which external conductors serve as contact plug pins, a rigid locking of the conductors in the pinch seal is of particular importance. In this connection it is of importance that in lamps according to the invention the strength of the welded joint of the external current conductor to the current leadthrough conductor be approximately 30% larger than in lamps having flat-ground or flattened current conductors.

In a preferred embodiment of the lamps according to the invention the shape given to the end of the external current conductor situated within the pinch seal is also given to the other end. In cases in which the current conductor serves as a contact plug pin it is even useful and desired that the other end has such a shape because in that case the pin is "searching."

The additional advantage of current conductors which are torpedo-like at both ends is that the current conductors upon assembling a lamp can be supplied in any manner to the welding machine for making the joint to the foil (which joint is preferably produced near the junction of the cylindrical and the the torpedo-like part part of the current conductors), whereas upon manufacturing the known lamps the conductors have to be supplied to the machine in such an oriented manner that the ground or flattened ends, are contacted with the foil.

It will be obvious that it is irrelevant to the invention whether the lamp is an incandescent lamp or a discharge lamp. In the former case the electrically conductive member situated within the lamp vessel is constituted by a filament, in the latter case it is constituted by an electrode. Nor does it make any difference for the gist of the invention whether the lamp vessel has one or two pinch seals and whether a pinch seal has one or several current leadthroughs.

As a rule the invention will be applied to lamps having a quartz glass lamp vessel and molybdenum current leadthroughs and external current conductors, in particular to highly loaded lamps in which the external current conductors have a diameter between 0.7 and 1.5 mm. The invention is therefore of particular importance for halogen incandescent lamps, more especially those having high pinch seal temperatures, for example projection lamps, in particular lamps which form part of a lamp/reflector unit.

The invention will be described in greater detail with reference to the following figures.

Figure 2:
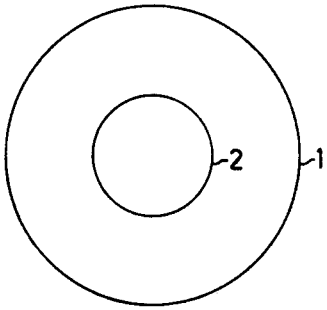
Figure 3:
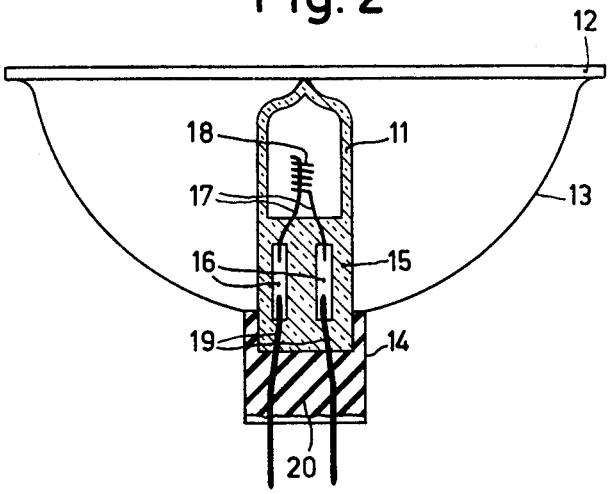

FIG. 1 is a longitudinal sectional view through an external current conductor having a torpedo-shaped end, FIG. 2 is a cross-sectional view taken on the line II — II, FIG. 3 is a sectional ciew through the axis of an incandescent lamp/reflector unit.

Reference numeral 1 in FIG. 1 denotes the cylindrical part of an external current conductor. 2 Denotes the torpedo-like end. The top 3 of said end is not blunted in the current conductor shown in the figure. The cylindrical part has a diameter *d*, the torpedo-shaped end has a length *l*.

FIG. 3 shows a halogen incandescent lamp having a quartz glass lamp vessel 11 in an aluminium reflector 12 with a largest diameter of 5 cm. A neck-shaped portion 14 in which the pinch 15 of the incandescent lamp is incorporated adjoins the reflecting portion 13 of the reflector. Present in the pinch are molybdenum foils 16 to one end of which are welded internal current conductors 17 to the filament 18 and to the other end of which are welded 1mm thick molybdenum external current conductors 19 which are torpedo-shaped at either end and serve as contact pins. The lamp is fixed in the reflector neck by means of cement 20.

The incandescent lamp is an 8V 50W halogen lamp filled with 3 atm. argon which contains 0.3 mol.% of methylene bromide.

During operation at the design voltage the lamp reached the end of life by fusion of the filament in the hottest place.

What is claimed is:

1. An electric lamp having a glass lamp vessel with at least one pinch seal, in which at least one metal foil is incorporated as a current leadthrough conductor to one end of which is connected an internal current conductor towards an electrically conductive member situated inside the lamp vessel and the opposite end of which is connected to an external current conductor comprising a cylindrical rod extending for the greater part outside the pinch seal, said rod having, at its end situated within the pinch seal, a non-cylindrical shape, characterized in that the external current conductor at its end situated in the pinch seal is in the form of a torpedo having a blunt or non-blunt tip, the length of the torpedo-like part being at least equal to the diameter of the cylindrical part, the diameter of the torpedo-shaped part at a distance from the cylindrical part of 0.9 times the cylinder diameter being at most equal to half the cylinder diameter.

2. An electric lamp as claimed in claim 1, characterized in that the external current conductor is torpedo-shaped also at its end situated outside the pinch seal.

* * * * *